United States Patent [19]

Knapp et al.

[11] Patent Number: 4,734,064

[45] Date of Patent: Mar. 29, 1988

[54] ELECTRICAL SOCKET CONTACT WITH CONVEX ENGAGING TINES

[75] Inventors: Anthony W. Knapp, Laurens; Joseph M. Buck, Binghamton, both of N.Y.

[73] Assignee: Amphenol Corporation, Wallingford, Conn.

[21] Appl. No.: 902,355

[22] Filed: Aug. 29, 1986

[51] Int. Cl.[4] ..... H01R 13/187

[52] U.S. Cl. ..... 439/852; 439/856; 439/862

[58] Field of Search ..... 339/256 R, 258 R, 258 P, 339/259 R; 439/852, 856, 862

[56] References Cited

U.S. PATENT DOCUMENTS

| | | | |
|---|---|---|---|
| 3,162,503 | 12/1964 | Warzecka | 339/258 P |
| 3,192,498 | 6/1965 | Ruehlmann | 339/33 |
| 3,406,376 | 9/1968 | Varrin | 339/258 |
| 3,862,792 | 1/1975 | Jayne | 339/258 R X |
| 4,278,317 | 7/1981 | Gallusser et al. | 339/258 R |
| 4,359,258 | 11/1982 | Palecek et al. | 339/258 R X |
| 4,431,256 | 2/1984 | Piscitelli et al. | 339/258 R |
| 4,456,324 | 6/1984 | Staeger | 339/177 R |
| 4,657,336 | 4/1987 | Johnson et al. | 439/852 |

FOREIGN PATENT DOCUMENTS 1272948 5/1972 United Kingdom .

*Primary Examiner*—William R. Briggs
*Attorney, Agent, or Firm*—Bacon & Thomas

[57] ABSTRACT

An electrical socket contact for receiving a pin contact, the socket comprising a forward end comprised of at least two elongated cantilever spring tines for receiving the pin, each spring tine extending from a concave cross-section adjacent to the body from which it extends and transitioning into a convex cross-section adjacent to its free end, the free ends being tulip-shaped to form an entry for guiding the pin contact into engagement by the convex portions. Apparatus for manufacturing the contact includes a center die having shaped grooves, arcuate segments which close together about the die and have shaped ribs which are received in a respective groove, and an entrance die having a hemispherical protrusion which is inserted into an opening defined by the closed segments.

5 Claims, 14 Drawing Figures

FIG. 2
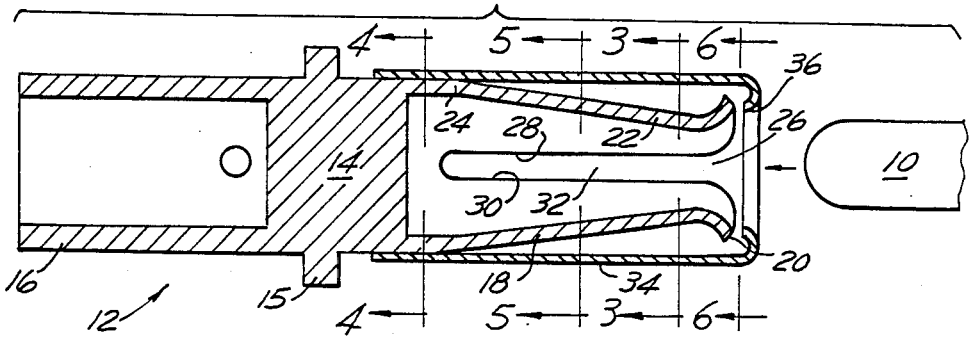
FIG. 3
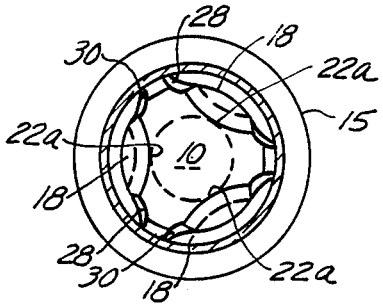
FIG. 4
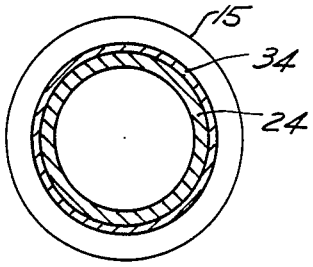
FIG. 5
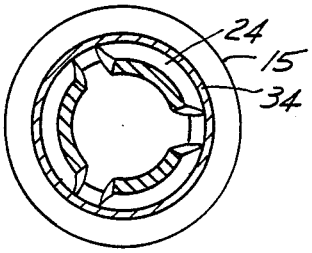
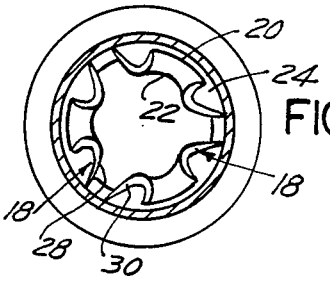
FIG. 6
FIG. 1
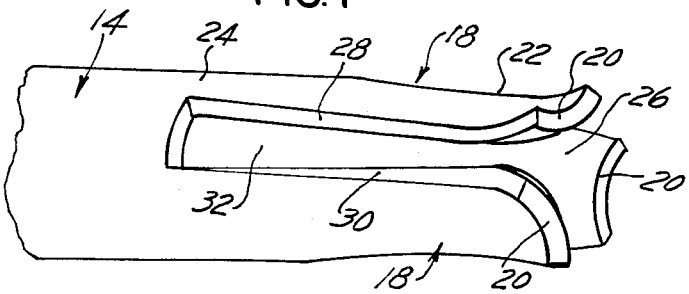

FIG.7
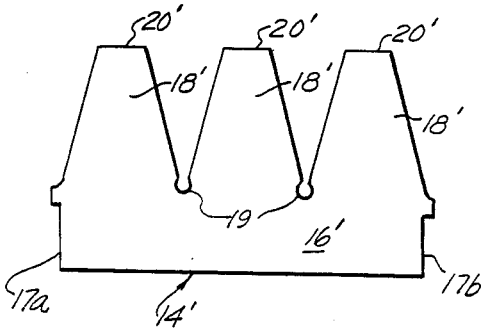
FIG.8
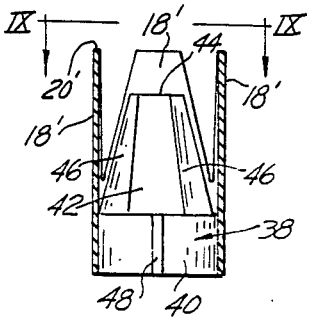
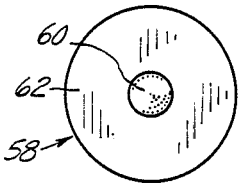
FIG.11
FIG.9
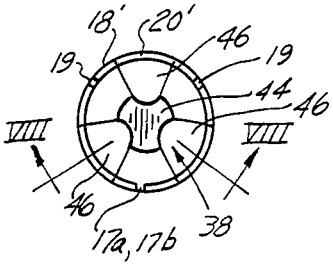
FIG.10
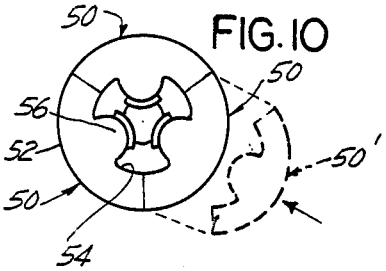
FIG.12
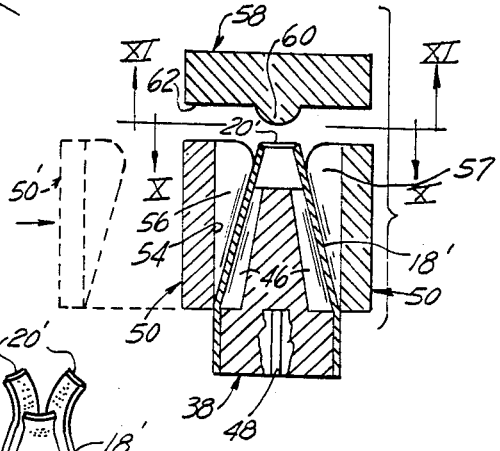
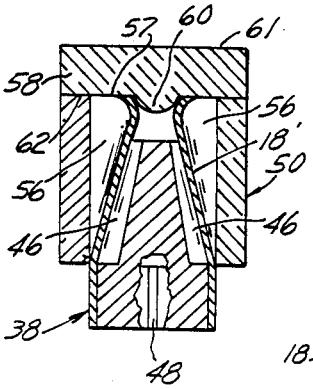
FIG.13
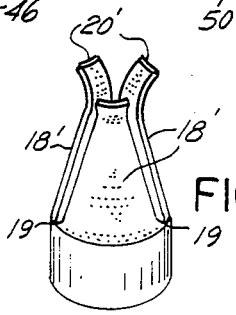
FIG.14

ELECTRICAL SOCKET CONTACT WITH CONVEX ENGAGING TINES

This invention relates to an electrical socket contact with convex tines for engaging a pin contact and a method of making the contact.

Socket contacts typically provide for two or more tines the cross-section of each tine being concave relative to the contact axis and configured to engage the outer periphery of a cylindrical pin contact inserted between the tines. U.S. Pat. No. 4,278,317 "Formed Socket Contact With Reenforcing Ridge" issued July 14, 1981 to Gallusser et al is an example of such contact. Due to sharp edges of machine cuts and burrs from saw cuts to form the concave tines the manufacturer can unwittingly build into the socket contact the mechanism that will degrade its mating pin contacts.

Current military specifications require a connector pair including its full complement of contact pairs to withstand durability tests whereby the contact pairs are mated 500 times and random and sine vibration testing both at increased levels and combined with temperature environments. Using concave tines it has been observed that during durability testing gold plating will wear away followed by the copper underplating thereby exposing the pin contact base metal. This contact wear increases the mating frictional force of the contact, increases the electrical contact resistance, and continues into the vibration tests wherein pin contacts have been observed as having been scalloped at the points where the socket tines made contact. The loss of pin contact material geometrically produces an open circuit or electrical discontinuity. Vibration testing at temperature also produces oxidation of the base metal thereby increasing the electrical resistance of the contact.

A desirable socket contact should not degrade the pin contact that it mates with.

An electrical socket contact for receiving a pin contact includes an elongated cylindrical body formed from electrically conductive material and having a forward end comprised of at least two elongated spring tines for receiving and engaging the pin. In particular the forward end is characterized in that each spring finger has a convex cross-section and extends as a cantilever from the body to a free end, the free ends forming a tulip-shaped entry for receiving the pin with the convex portion of each engaging the pin contact. Longitudinal edges defining the spring tines are free from engagement with the pin contact.

A flat sheet of metal is formed into the socket contact as a result of the sheet being stamped into a desired pattern having sheet portions and wrapped about a center die provided with shaping grooves, three arcuate segments compressing the sheet portions radially inward about the die each segment having a forming rib which drives one sheet portion into one groove, and a hemispherical entrance form coaxially deforming the sheet portions to complete formation of tines which transition from concave to convex and terminate in tulip shaped ends.

An advantage of a contact having a tulip entry and convex tines is assurance of pin alignment with positive and controlled engaging force with the pin contact. Further, since no sharp edges or burrs come into contact with the pin contact, near perfect and uniform wear is achieved.

A more complete understanding of this invention may be obtained from the detailed description that follows taken with the following drawings:

FIG. 1 shows a socket contact part having spring tines that form a tulip shaped entry for receiving a pin contact.

FIG. 2 shows the socket contact in section positioned for mating with the pin contact.

FIG. 3 is taken along lines III—III of FIG. 1 to show a mated connection with the pin contact.

FIGS. 4–6 show in section the spring tines at selected locations along the socket contact part shown in FIG. 1.

FIG. 7 shows a stamped sheet of metal.

FIG. 8 shows a side view of the sheet rolled around a center die taken along lines VIII—VIII of FIG. 9.

FIG. 9 shows an end view looking along lines IX—IX of FIG. 8.

FIG. 10 shows a forming die assembled and compressed about the assembly of FIG. 8 and taken along lines X—X of FIG. 12.

FIG. 11 shows an entrance die taken along lines XI—XI of FIG. 12.

FIG. 12 shows the dies positioned about the metal sheet.

FIG. 13 shows the metal sheet deformed by the dies shown in FIG. 12.

FIG. 14 shows a finished contact formed from the sheet by the dies.

Referring now to the drawing, FIG. 1 shows part of a socket contact 12 as including a body 14 and three spring tines 18, each tine extending from the body and terminating in a free end 20 whereby to define a tulip shaped entry 26 (i.e., opening) for receiving a pin contact 10, and adjacent tines 18 being separated by a longitudinally extending slot 32. Each tine is arcuate in cross-section and undergoes a transition from a concave cross-section 24 where it is joined to the body to a convex cross-section 22 immediately adjacent to its free end 20.

FIG. 2 shows the socket contact 12 positioned for mating with the pin contact 10. While not shown and conventional to those skilled in the art, each contact would be mounted in the passage of a dielectric insert and the inserts retained within a matable connector shell. The pin contact is comprised of an electrically conductive metal and includes a rearward end portion for termination to a wire (not shown) and a generally elongated cylindrical forward end portion 11 configured for insertion into the socket.

The socket contact 12 is comprised of the cylindrical body 14 machined from metal and includes a rearward end portion 16 for termination to a wire, a medial portion having a retention flange 15 for mounting in its insert, and a forward end portion for mating with the pin. As shown, the forward end portion is comprised of the spring tines being integral with and extending coaxially from the medial portion, each spring tine terminating in a radially deflectable free end and having a pair of longitudinally extending edges 28,30.

In particular each spring tine 18 transforms from the concave cross-section 24 where it is connected to the body 14 and into the convex cross-section 22 adjacent to its free end, the convex portions being adapted to engage the pin contact. Each tine is tulip-shaped adjacent to its free end 20 with the tine free ends cooperating to define the entry throat 26 for receiving the pin contact, the entry assuring both that the pin contact is coaxially aligned with the socket contact and that tine edges 28, 30 do not engage the pin contact. A longitudinal slot 32 separates adjacent spring tines.

A one piece elongated cylindrical hood 34 is mounted to the contact body to protect the spring tines and guide the pin contact into the socket. The hood completely encircles the spring tines and has at its forward end an inwardly converging flange 36 that forms a throat for coaxially guiding the pin into the tines.

FIG. 3 shows the mated condition of the pin contact 10 in the socket contact 12. The convex section 22 from each of three generally equiangularly positioned and angularly separated tines 18 engages the pin contact. While the tine contact is shown as contacting the pin at only at one point 22a, the convex contacting section of each tine could be axially elongated such that the convex portion of each tine would engage the pin contact outer periphery along a line.

FIGS. 4–6 section the socket at various axial locations and show the tines undergoing a transition from a concave cross-section to a convex cross-section. FIG. 4 shows the spring tines 18 as being concave in cross-section at their roots.

FIG. 5 shows the spring tines at their medial portion as being both concave and convex in cross-section. Such a construction automatically stiffens the spring tine so as to resist outward radial deflection whereby to assure positive contact with the pin contact surface. Maintenance of good spring force is important to break through the oxides that may build up on the pin and to assure proper electrical continuity. Depending on the length of the spring tines 18 and the configuration of the slot 32 formed between adjacent spring tines (i.e., the ratio of tine width measured at the tine root and tine free end and whether the edges between adjacent tine edges are parallel or diverge), the spring force can be changed.

FIG. 6 shows the spring tines at their free ends adjacent to the tulip entry.

While the socket contact has been shown machined from metal stock, the socket could also be stamped and form from a sheet of metal. If desired, more tines could be provided.

FIG. 7 shows a flat metal sheet 14' stamped so as to include three triangular portions 18' each extending from a body portion 16' and terminating in free ends 20'. Adjacent of the triangular portions are separated by a notch 19 for stress relief. The sheet includes opposite edges **17*a*, 17*b*** which are adapted to confront when the sheet is rolled into a cylinder.

FIG. 8 shows a side view of the sheet rolled around a center die 38 including a cylindrical base 40 and a tapered member 42 extending coaxially forward therefrom and terminating on a forward endface 44. Shaped grooves 46 extend from the body and transition as concave surfaces to terminate on the endface as convex surfaces. The base includes a key 48 which serves as stops for the edges **17*a*, 17*b*** when wrapped therearound.

FIG. 9 shows an end view of the sheet 14' wrapped around the center die. The triangular portions will become the tines 18.

FIG. 10 shows three arcuate segments 50 assembled about the center die 38 as a result of having been forced radially inward to deform the triangular portions 18'. Each of the segments 50 are alike and when assembled define a forming die. The segments are elongated and include a cylindrical body 52 having lateral sidewalls and a cylindrical inner wall 54. the sidewalls from adjacent segments abutting when assembled whereby to close about the center die. A longitudinal rib 56 extends along the inner wall configured to seat within one of the shaping grooves 46 to change the shape of the triangular portions 18' from flat to concave/convex. One of the segments, designated 50', is shown in phantom and removed to indicate its radial compression about the center die.

FIG. 11 shows an entrance die 58 which is generally cylindrical and has extending upwardly from an action surface 62 a hemispherically shaped entrance form 60.

FIG. 12 shows the segments 50 assembled into a forming die about the center die 38 and deforming the sheet 14' thereabout and the entrance die 58 positioned for action about the other dies. The entrance form 60 is positioned to be driven into the throad defined by the free ends 20' of the triangular portions 18'. Each of the longitudinal ribs terminate in rounded forming shoulders 57 adjacent to to free ends 20'.

FIG. 13 shows the metal sheet 14' deformed by the cooperative action of the center die 38, the forming die segments 50, and the entrance die 58. Downward coaxial insertion of the entrance form 60 into the throat described by the ends 20' cause the ends to be driven against the forming shoulders 57 whereby to form a tulip shaped tine.

FIG. 14 shows a finished socket contact having concave and convex tines stamped from the sheet and formed by the dies.

Having described the invention, what is claimed is:

1. An electrical socket contact for receiving a pin contact, said socket comprising an elongated cylindrical body formed from electrically conductive material and having a forward end comprised of at least two elongated spring tines, substantially identical in configuration, for receiving the pin, the socket characterized in that each spring tine extends as a cantilever from the body to a free end and has a convex cross-section adjacent its free end for engaging the pin contact, the tines collectively and uniformly transition from the convex cross-sections into concave cross-sections adjacent to the body from which the tines extend, and the free ends cooperating to form a tulip-shaped entry for guiding the pin contract.

2. The electrical socket contact as recited in claim 1 wherein each spring tine has a pair of longitudinally extending edges each said edge being spaced away from and in disengaged relation with the pin contact.

3. The electrical socket contact as recited in claim 1 including guide means for guiding the pin contact to the spring tines, said guide means comprising an elongated cylindrical hood encircling the spring tines and having an inwardly converging throat for guiding the pin into the socket contact.

4. The electrical socket contact as recited in claim 2 wherein the covex portion of each spring tine is longitudinally extending whereby to assure a linear engagement with the outer periphery of the pin contact.

5. The electrical socket contact as recited in claim 2 wherein the edges of adjacent spring tines define a longitudinally extending slot having an angular separation adjacent to the roots which is different than that adjacent to the free ends.

* * * * *